United States Patent [19]

Brown

[11] Patent Number: 4,738,556

[45] Date of Patent: Apr. 19, 1988

[54] FINGER PEN

[76] Inventor: James Brown, 2330-10 Grove Ave., San Diego, Calif. 92154

[21] Appl. No.: 2,445

[22] Filed: Jan. 12, 1987

[51] Int. Cl.[4] ..... B43K 29/00; B43K 7/00

[52] U.S. Cl. ..... 401/7; 15/443; 401/8

[58] Field of Search ..... 401/7, 8; 15/443

[56] References Cited

U.S. PATENT DOCUMENTS

| | | | |
|---|---|---|---|
| 737,085 | 8/1903 | Davies | 15/443 |
| 2,177,205 | 10/1939 | Dalmas | 401/7 |
| 2,921,590 | 1/1960 | Holton | 401/8 |
| 3,887,286 | 6/1975 | Bucey | 401/7 |
| 4,127,338 | 11/1978 | Laybourne | 401/8 |
| 4,511,272 | 4/1985 | Brown | 401/6 |

FOREIGN PATENT DOCUMENTS

| | | | |
|---|---|---|---|
| 1214577 | 4/1960 | France | 401/8 |
| 615431 | 2/1961 | Italy | 401/7 |

*Primary Examiner*—Steven A. Bratlie
*Attorney, Agent, or Firm*—Ralph S. Branscomb

[57] ABSTRACT

A finger-mounted ball point pen utilizes a padded tray that passes along the ventral side of the index finger, with a padded tip, and a Velcro tm strap which secures the end of the index finger to the tray. Once secured to the index finger, the user can write in a normal fashion with little or no support from the other fingers or the thumb.

2 Claims, 1 Drawing Sheet

FINGER PEN

BACKGROUND OF THE INVENTION

Pens and pencils are notoriously difficult to grasp and use, primarily because of their narrow diameter. Children have difficulty with this, and often use over-sized pens or pencils. There has even been a rubber slip-on "adaptor", which is externally conformed to fit the index, middle finger and thumb of the user, which provides a better grip and a larger diameter gripping surface.

Arthritics and handicapped people also have trouble gripping and using narrow diameter pens and pencils. Devices have been developed to assist these people as well in gripping small diameter objects. However, these devices, as well as the "adaptor" used by children and perhaps some arthritics, require the utilization of the same three fingers that are ordinarily used to grip a pen or a pencil, and in some instances require the use of the entire hand. There is a need, therefore, for a simplified device which can be utilized by children, arthritics and other handicapped people, and which positively engages a finger, rather than merely expanding the gripping region.

SUMMARY OF THE INVENTION

The instant invention fulfills the above stated need and comprises a short ball point pen element which is strapped to the end of the index finger. Because it is securely engaged by the index finger, the index finger is all one needs to use the pen. The pen could, of course, be engaged on another finger instead of the index finger, so that a person having only one finger could use the pen, and an arthritic having trouble gripping pens would not even have to worry about gripping this pen. The pen is secure enough on the fingertip that it does not really require the guidance of the thumb and middle finger, so that these fingers could be used to assist the writing to whatever extent the fingers are functional, but their inability to grasp a pen would not render the invention unusable.

Several embodiments of the invention disclose different means of providing the ball at the pen tip with ink, including a solid conical reservoir in the pen tip, a coiled ink tube, and a tube which runs up inside the finger engaging member.

DETAILED DESCRIPTION OF THE PREFERRED EMBODIMENT

Figure 3:
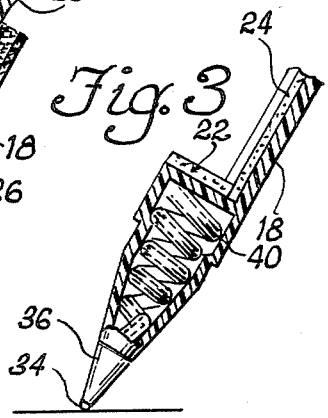
FIG. 3 is a vertical section taken through the tip and a portion of the fingertip engaging member.
Figure 4:
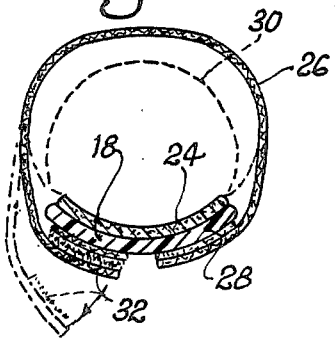
FIG. 4 is a section taken along line 4—4 of FIG. 1.

The invention comprises two basic parts in the illustrated embodiments. As illustrated in FIG. 3, the pen tip 10 is mounted on a collar portion 12 of a fingertip engaging member 14. The finger tip engaging member includes a flat cover 16 for the collar 12, and an integral finger tray 18 extends up from the collar having a curved upper edge 20 for the comfort of the user.

Also for the comfort of the user, a pad 22 is disposed just above the element 16, and a second, thin pad 24 is bonded to the surface of the finger tray 18 for the comfort of the user.

Figure 5:
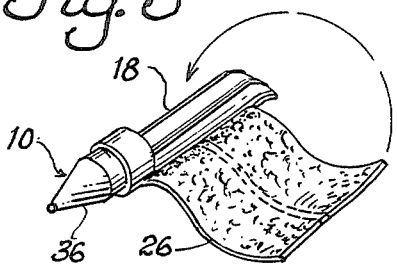
FIG. 5 is a perspective view of the invention after it has been removed from the finger.
Figure 6:
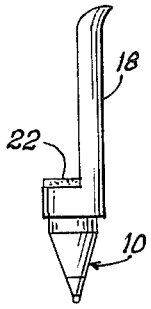
FIG. 6 is a side elevation view of the invention.

A strap 26 is mounted at one end 28 to the outside of the finger tray 18, and can be wrapped around the finger 30, so that the other end engages onto the finger tray by virtue of the mating loop-and-fastener material (Velcro) 32. The strap can come in two or more narrower straps as indicated by the dotted line in FIG. 5, and in either event wraps around the finger snugly, so that the finger is compressed against both pads 22 and 24, and the pen tip 10 is thus mounted securely enough to permit controlled writing with the pen tip.

Figure 1:
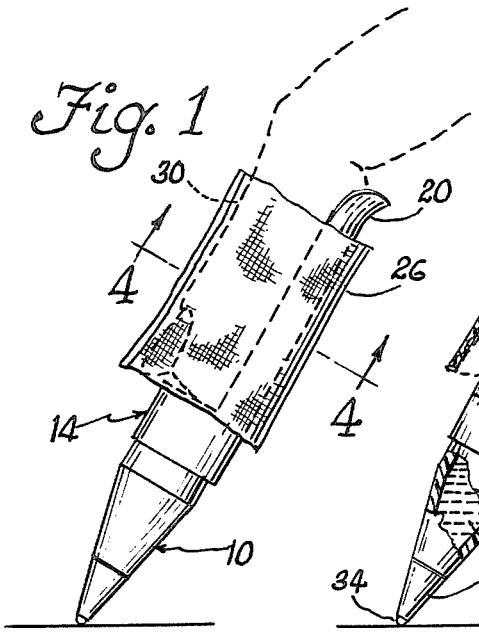
FIG. 1 illustrates the invention strapped on the index finger of a user, showing the finger in phantom.
Figure 2:
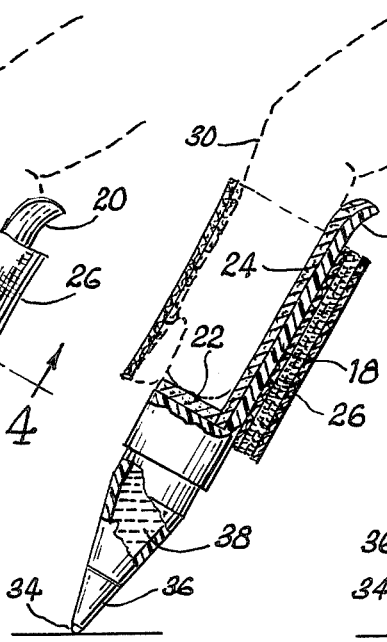
FIG. 2 is the same view as FIG. 1, but with portions of the device sectioned to illustrate the composition.

The pen tip itself can be any standard type pen tip, having a ball 34 at the end of the point 36 of the cone-shaped tip. The ball 34 obviously must be provided with a continuous supply of ball point ink, which is accomplished by utilizing a reservoir which is illustrated in three different embodiments. First, as shown in FIG. 2, the entire conical pen tip 10 may be open and filled with ink 38. Alternatively, a conventional ball point pen type tube cartridge 40 can be used, and coiled around inside the pen tip 10 as shown in FIG. 3. In either event, whereas the entire pen would ordinarily be cheap enough to be discarded and replaced as a conventional ball point when the ink runs dry, alternatively the pen tip 10 could be made removeable from the fingertip engaging member 14 so that the tip itself, housing the exhausted ink reservoir, could be replaced.

Figure 9:
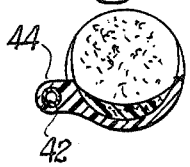
FIG. 9 is a section taken through a modified form of the invention in which the ink reservoir tube passes alongside the main body of the finger tray; and, FIG. 10, similar to FIG. 9, is a modification in which the ink reservoir tube passes externally of the main body of the finger tray.
Figure 7:
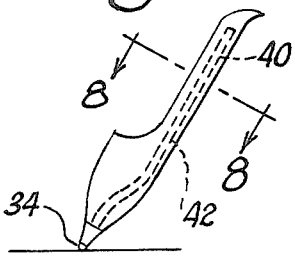
FIG. 7 is a side elevation view of a modified form of the invention in which the ink reservoir is a conventional ink tube passing up through a canal in the fingertip engaging member.
Figure 8:
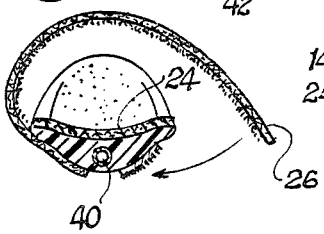
FIG. 8 is a section taken along 8—8 of FIG. 7.
Figure 10:
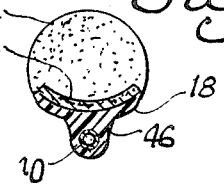

Other arrangements utilizing a tube ink reservoir are shown in FIGS. 7–10. In FIGS. 7 and 8, a standard ink reservoir tube 40 extends up inside a canal 42 inside the finger tray 18. The reservoir would thus not be visible in ordinary use. In a modified design, FIG. 9 illustrates how the tube reservoir could run externally alongside the finger tray, held in place by support rib 44, and FIG. 10 is similar except that the tube runs along the outside of the finger tray and is supported by a rib 46.

In all the embodiments, the invention is easy to use by anybody, and particularly by those who have difficulty holding an ordinary ball point steady enough to write. Modifications involving the particular arrangement of the ink reservoir and the fingertip engaging member beyond those illustrated, are considered to be within the ambit of the invention and the scope of the appended claims. The essence of the invention is the incorporation of the pen tip, complete with ink reservoir and writing ball, with a member which engages one sole finger tip and enables the writer to write even though he may only have one finger.

I claim:

1. A fingertip-mounted pen comprising:

(a) a fingertip-engaging member having means to securely engage the end of the index finger;

(b) a pen tip extending from said fingertip-engaging member and having a point mounting a ball point pen ball, and an ink reservoir communicating with said ball to supply same with ink;

(c) said fingertip-engaging member and pen tip being configured to enable the user to engage said member on the tip of the index finger and write with said pen, with said ball being in substantially the position relative to the hand of the user as it would be when utilizing a standard ball point pen;

(d) said fingertip-engaging member including a finger tray for extending along the ventral side of the index finger and a finger strap connected to said tray wrapping around the index finger and holding same to the finger tray;

(e) said finger tray having an outside, and said strap having an end mounted to said outside, and both a portion of said outside and the other end of said strap mounting hook-and-loop fastener materials so that said strap can be wrapped around an index finger and engaged by said hook-and-loop fastener material to the outside of said finger tray;

(f) a fingertip pad mounted in between said finger tray and positioned to pad a fingertip when said pen is in use; and, (g) padding disposed along the side of said finger tray adjacent to finger so that the index finger and said fingertip-engaging member is padded both at its tip and along the ventral side thereof when said pen is in use.

2. Structure according to claim 1 wherein said pen tip is hollow and said reservoir comprises a coiled decreasing helical ink tube disposed within said hollow pen tip.

* * * * *